United States Patent [19]

Groelz

[11] Patent Number: 4,565,134

[45] Date of Patent: Jan. 21, 1986

[54] CYLINDRICAL SURFACE RAILCAR CENTER PLATE

[76] Inventor: Philip Groelz, 15828 S. Thayer Rd., Oregon City, Oreg. 97045

[21] Appl. No.: 594,920

[22] Filed: Mar. 28, 1984

[51] Int. Cl.[4] ..... B61F 5/16

[52] U.S. Cl. ..... 105/199 C; 308/2 R; 384/422

[58] Field of Search ..... 105/199 R, 199 C, 199 CB; 308/2 R; 384/421, 422, 423

[56] References Cited

U.S. PATENT DOCUMENTS

| | | | |
|---|---|---|---|
| 197,940 | 12/1877 | Mason | 105/199 R |
| 974,832 | 11/1910 | Schwartz | 384/423 |
| 1,737,160 | 11/1929 | Johnston | 105/199 R |
| 1,831,416 | 11/1931 | Junkers | 308/2 R |
| 3,667,820 | 12/1970 | Sherrick | 308/137 |
| 3,709,151 | 1/1973 | Cook et al. | 105/199 C |
| 3,831,530 | 8/1974 | Cope et al. | 105/199 C |
| 3,847,090 | 11/1974 | Love et al. | 105/199 C |
| 4,206,710 | 6/1980 | Spence | 105/420 |

*Primary Examiner*—Louis J. Casaregola

[57] ABSTRACT

A railway car center plate formed with a convex cylindrical lower surface which bears, in rocking fashion, upon the flat load supporting face of a standard truck bolster bowl. The arrangement may have one or more side bearings with elastomeric material or springs to enhance stability. In another form of the invention, the truck bowl is formed with an upwardly facing convex cylindrical bottom surface which mates with a standard flat bottomed center plate. Convex cylindrical mating surfaces on both the center plate and the truck bolster is a third form of the invention.

2 Claims, 3 Drawing Figures

CYLINDRICAL SURFACE RAILCAR CENTER PLATE

This invention relates to railcars, and particularly to the center plate and truck bolster by which the loads of the railcar are transferred to the railcar truck assembly.

The standard railcar center plate used in the United States has a flat under surface which is circular in shape except for being truncated laterally to provide parallel side edges, beyond which the center plate is beveled, as described in U.S. Pat. No. 4,206,710. These bevels provide fulcrums about which the center plate pivots when lateral forces cause the car body to roll with respect to the truck assembly, as occurs frequently during transit. These bevels convert point contact, with high unit stresses, into line contact at the edge of the the bevels to achieve lower stresses within the center plate.

Conical center plate surfaces are described by U.S. Pat. No. 3,831,530 and U.S. Pat. No. 3,847,090. U.S. Pat. No. 3,667,820 describes a conical center plate surface which contains an elastomeric cushion between the mating surfaces of the center plate and the truck bolster. A spherical mating surface is described by U.S. Pat. No. 3,709,151, as well as cylindrical mating surfaces, one of which is convex and the other concave.

Each of the previously described center plates have disadvantages associated with them. With both the flat center plate, and the conical center plate arrangements (which do no include the elastomeric pad), when rocking occurs between the center plate and the truck bolster, loading occurs at or near one edge of the center plate and is transferred to the structure of the car body directly above that area. With all the load carried on one side of the center plate, the structure above the other side becomes unloaded. Rocking to the other edge reverses the effects. Fatigue damage, particularly with welded structures, is determined by the number of stress cycles and the stress ranges experienced by the metal during those stress cycles. Railcars which are in high mileage service frequently exhibit signs of fatigue damage in the car structure above the center plate.

The conical center plate designs require that the trucks be especially designed to accept this shape. Thus existing trucks designed for flat bottomed center plates cannot be utilized, and these comprise essentially the entire fleet of freight hauling railcars.

The spherical center plate and cylindrical center plate arrangements described in U.S. Pat. No. 3,709,151 result in connections between the railcar and the truck which are inherently unstable. Auxiliary devices are thus required to produce longitudinal and lateral stability between the car body and the truck bolster. Rotative forces upon the truck bolster are particularly high during brake applications and during the impacts which occur between cars while the train, or portions of it are accelerating and decelerating. Proper function of the concave/convex cylindrical arrangement is dependent upon the truck bolster insert being free to pivot within the bowl of the truck bolster and also being keyed to maintain its alignment relative to the body center plate.

I have determined that a cure for each of these problems would be achieved by changing the mating surfaces from flat to a large radius cylindrical curvature, with the axis of the cylinder aligned with the long axis of the railcar. When the centrex of the radius is placed above the center of gravity of the railcar, positive stability is achieved, and when the radius is considerably above the center of gravity of the railcar, analysis shows that the restoring forces effecting dynamic stability are essentially the same as for a flat center plate (i.e., the natural oscillatory behaviour is nearly identical for a large radius center plate as for a flat center plate). The convex cylindrically curved surface mating with either a flat surface or another convex cylindrical surface offers the advantage, during rocking motions, that small rocking motions result in small changes in the distribution of forces in the supporting structure and therefore result in small stress ranges. Reducing the stress ranges to small values greatly increases the fatigue lives of the railcar structures and the truck bolsters.

Compared with the conical center plate which has an elastomeric cushion, the cylindrical center plate can be retrofitted on cars which are using trucks designed for the conventional flat center plate, while the conical requires trucks which are specially manufactured to receive the conical center plate arrangement. The cylindrical surface is also less expensive to manufacture.

Compared with the spherical center plate, when my cylindrical surfaces have large radii, the car is inherently stable, while the spherical center plate arrangement is not. Also, rocking between my truck and center plate results in rolling friction for the cylindrical surfaces rather than sliding friction or edge contact conditions for the spherical and concave/convex cylindrical surfaces. While an insert is required for both the spherical and concave/convex cylindrical mating surface arrangement, my convex-to-flat and convex-to-convex arrangements eliminate this additional piece.

DESCRIPTION

Figure 1:
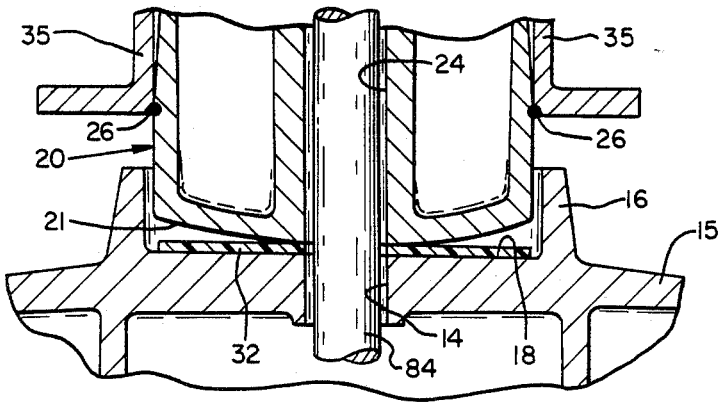
FIG. 1 is a fragmentary transverse midsectional view through structure embodying the concepts of my invention.

FIG. 1 shows a center plate assembly 20 with a convex cylindrical lower surface constructed as a one piece center filler. The axis of the cylinder is longitudinal of the car. The center plate is contained within the center bowl recess formed by a circular flange 16 projecting upward from the truck bolster 15. The center plate lower surface 21 transfers its load to the upper bearing surface 18 of the truck center plate bowl. A bearing plate 32 made of an elastomer or metal may be inserted between the center filler and the upper surface of the center plate bowl as a replaceable wear reducing material.

Figure 2:
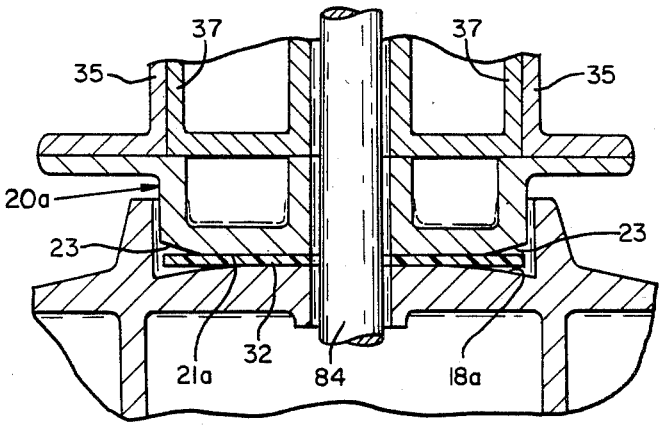
FIG. 2 is a similar view, but through a modified form of the invention.
Figure 3:
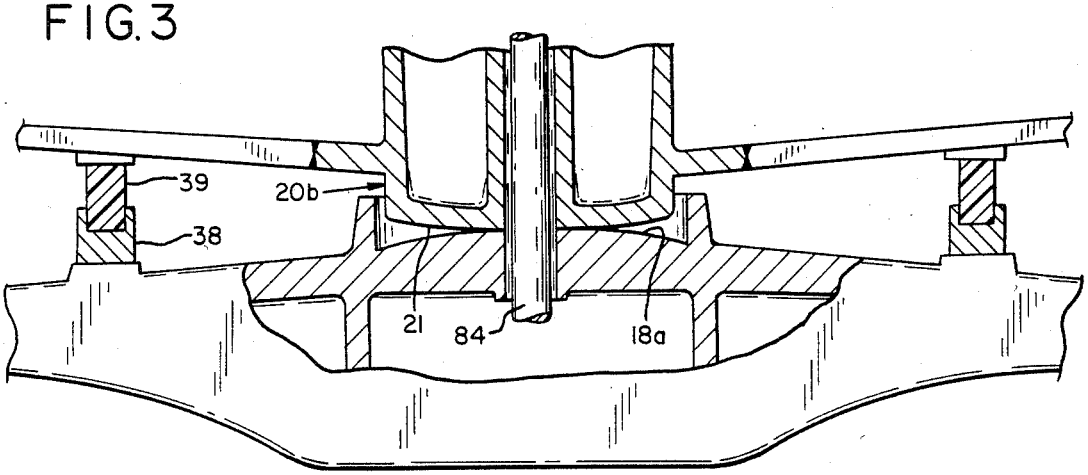
FIG. 3 is a similar view, but of a further form of the invention.

The center filler may be attached to the center sill 35 by welding 26, or by bolting or riveting as shown in FIG. 2, or it could be cast integrally with the center sill as shown in FIG. 3. A vertical king pin 84 fits in holes bored in the truck bolster 14 and in the center filler 24, to prevent the trucks from becoming dislocated from the car body in the event that the car body becomes vertically separated from the truck. As this connection is standard practice in the railroad industry, it will not be described further.

FIG. 2 shows a separable center plate assembly **20*a* having the standard flat lower surface 21*a* and bevels 23 at the edges, all contained within a truck bolster center bowl which has a convex cylindrically curved load bearing surface 18***a*. The curvature is about an axis longitudinal of the car. The center plate loads are transferred into a center sill insert 37 and the center sill 35, to which it is attached by bolting or riveting.

FIG. 3 shows a center sill with integral center plate assembly 20*b* which has a cylindrically curved lower surface 21 contained within a truck bolster bowl, which has a convex cylindrically curved load bearing surface 18*a*. Both curvatures are about axes longitudinal of the car.

What is claimed is:

1. In a center plate structure for a railway car, a truck bolster having a center plate bowl facing upwardly, the bowl having an outer circular rim and a flat bearing surface within the rim, the car body having a center plate with a lower bearing surface having a cylindrical portion which is convex and cylindrical which bears, in rocking fashion, upon the center bowl surface, the axis of the cylindrical surface being aligned generally parallel with the longitudinal axis of the car, the radius of the cylindrical curvature being greater than the vertical distance between the center plate and the center of gravity of the car body (either when loaded or unloaded) and being either constant, as in a circular cylinder, or varying, as in a generally ellipsoid cylinder.

2. In a center plate structure for a railway car as set forth in claim 1 wherein there is at least one side bearing with springs or elastomeric material spaced from the center plate bowl for creating a force which tends to restore parallelism between the car body and the truck bolster.

* * * * *